US006446974B1

(12) United States Patent
Malone et al.

(10) Patent No.: US 6,446,974 B1
(45) Date of Patent: Sep. 10, 2002

(54) DURABLE SYSTEM FOR CONTROLLING THE DISPOSITION OF EXPENDED MUNITIONS FIRED AT A TARGET POSITIONED CLOSE TO THE SHOOTER

(75) Inventors: Philip Garcin Malone, Vicksburg; Charles Arthur Weiss, Jr., Clinton, both of MS (US); Brad Leslie Huntsman, Dayton; Brent Elliot Huntsman, Xenia, both of OH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/801,175

(22) Filed: Mar. 5, 2001

(51) Int. Cl.[7] ..... F41J 1/12
(52) U.S. Cl. ..... 273/410
(58) Field of Search ..... 273/403, 404, 273/408, 348.4, 348.5, 410

(56) References Cited

U.S. PATENT DOCUMENTS

| | | | | |
|---|---|---|---|---|
| 1,363,677 A | * | 12/1920 | Serra | 258/20 |
| 2,092,162 A | * | 9/1937 | Hiatt | 273/348.5 |
| 4,195,839 A | * | 4/1980 | Rodrigue | 273/403 |
| 4,821,620 A | | 4/1989 | Cartee | 89/36.02 |
| 5,486,008 A | | 1/1996 | Coburn | 273/410 |
| 5,564,712 A | | 10/1996 | Werner | 273/410 |
| 5,718,434 A | | 2/1998 | Alward | 273/410 |
| 5,988,647 A | | 11/1999 | Porter et al. | 273/410 |

FOREIGN PATENT DOCUMENTS

| | | | |
|---|---|---|---|
| CH | 390097 | * | 7/1965 |
| DE | 3212781 | * | 10/1983 |
| DE | 4006230 | * | 8/1991 |
| FR | 358951 | * | 3/1906 |

* cited by examiner

*Primary Examiner*—Mark S. Graham
(74) *Attorney, Agent, or Firm*—Earl H. Baugher

(57) ABSTRACT

In a shooting range for training personnel in the use of firearms, a bullet trap that prevents rebounding bullets or flying debris from injuring shooters, has a central section of stacked cylindrical logs, or logs having a trapezoidal cross section, supported by stacked rectangular supporting blocks on each side. The stacked cylindrical logs have conical end sections at the end facing the shooter. These conical end sections direct incoming bullets to passageways between the cylindrical logs. Bullets passing through these passageways then strike a backstop panel. In a preferred embodiment, both the cylindrical logs and the backstop panel are made of shock-absorbing foamed fiber-reinforced concrete.

23 Claims, 2 Drawing Sheets

DURABLE SYSTEM FOR CONTROLLING THE DISPOSITION OF EXPENDED MUNITIONS FIRED AT A TARGET POSITIONED CLOSE TO THE SHOOTER

GOVERNMENT INTEREST STATEMENT

The invention described herein may be manufactured, licensed and used by or for governmental purposes without the payment of any royalties thereon.

I. BACKGROUND OF THE INVENTION

1. Field of the Invention

This invention relates to a system that permits an operator to fire heavy caliber firearms, e.g., 0.50 caliber, at short ranges with reduced backsplatter of target material and ricocheting bullet fragments.

2. Prior Art

Bullet screens and traps used on firing ranges are known to the art. U.S. Pat. No. 4,821,620 discloses an anti-spatter screen made of rubber-like material adapted to self-closing is secured to the front face of a deflector plate. U.S. Pat. No. 5,564,712 discloses a bullet trap for indoor shooting with small arms using a vertically-suspended rubber curtain and a vertically-suspended steel impact plate. U.S. Pat. No. 5,486,008 describes a bullet trap having a passageway between upper and lower boundary walls converging on a deceleration chamber. U.S. Pat. No. 5,718,434 discloses a bullet trap for pistol and rifle ranges having one or more deflecting plates having curved sections which direct bullets toward a back wall and a final impact plate. U.S. Pat. No. 5,988,647 describes a projectile trap having three groups of suspended polyurethane sheets in which these sheets have increasing hardness as a bullet traverses them.

II. SUMMARY OF THE INVENTION

An embodiment of the invention provides a screen in a target system that is durable, nonflammable, and reduces backsplatter of material dislodged by a bullet and ricochet of bullet fragments from a target or its backstop. The screen is more durable than conventional target systems such as those using wood or elastomers for screen material. Conventional materials not only need replacement more often but also are flammable when used with certain incendiary munitions. A novel feature of the screen of an embodiment of the present invention is a tapered end on each of the hard cementitious individual fill elements that is faced to the shooter.

In one embodiment, the bullet screen is supported along its vertical edges by stacked blocks of appropriate strength to contain the combined weight of components that comprise the screen. The components may be cylinders having conical ends, the points of which are faced to the shooter. The cylinders may be stacked one above the other, i.e., in a "square" configuration, or offset between the underlying cylinders, i.e., in an "equilateral triangle" configuration. Another embodiment envisions the components having a trapezoidal cross section as opposed to the circular cross section of the cylinders. These trapezoidal components would be stacked one on top of the other or stacked offset much the same as the cylinders may be. The ends of these trapezoidal elements may be tapered toward a chisel end configuration with four planes tapering from the point to each of the sides of the trapezoid, much like a cold chisel. This tapered portion would face the shooter, thus offering the same advantages as the cylindrical components in determining the direction an impacting bullet would most likely take.

Either configuration provides openings along the sides of the screen's components for bullets and debris to pass. The direction that a bullet takes upon impact is influenced by initial impact at a necessarily shallow angle on the conical or wedge-shaped front of 30 the screen's components. This low impact angle serves to direct the bullet as well as any dislodged debris toward the rear of the components and into a backstop rather than ricocheting off the typically flat surface of a conventional durable hard target such as a masonry wall. Further, the bullet may experience multiple low angle impacts on multiple conical or wedge sections thus the screen may absorb much of its energy while also directing its flight to the backstop.

In a preferred embodiment, the components of the screen are fabricated from shock-absorbing, foamed, fiber-reinforced concrete. Further, the concrete may contain an excess of calcium hydroxide. Upon exposure to moisture, the excess calcium hydroxide produces a slightly alkaline leachate that interacts with the heavy metals, such as lead, that are components of the bullets impacting the screen. This interaction stabilizes any heavy metal embedded in the screen, immobilizing it and preventing it from leaching into the groundwater. A further advantage of the screen is that it requires little maintenance, e.g., it requires no coatings to deter rot or insect damage. Because it is impervious to natural erosion and constructed of durable materials, it has an inherently longer service life. Finally, the screen may be used in applications that use incendiary, deflagrating or tracer munitions on the range because it is nonflammable. Other materials, such as wood or elastomers, may be used in building bullet traps where fire hazards are low and durability is of secondary importance.

III. BRIEF DESCRIPTION OF THE DRAWINGS

IV. DETAILED DESCRIPTION OF THE INVENTION

Figure 1:
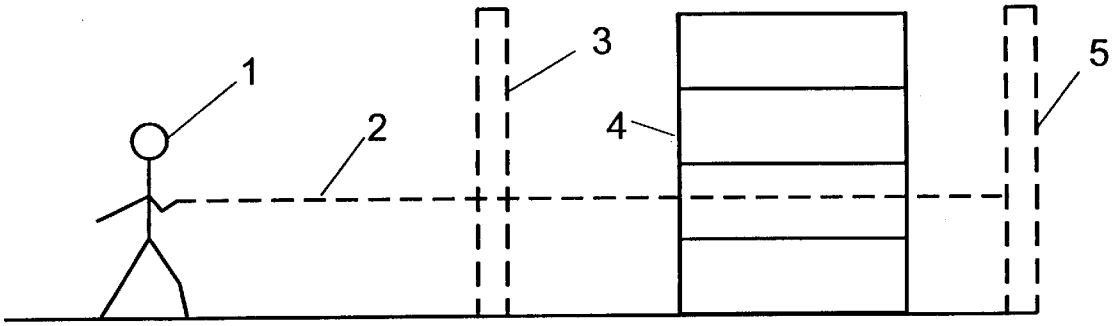
FIG. 1 is a side view of a preferred embodiment of the present invention showing the relative position of the shooter to it.
Figure 3:
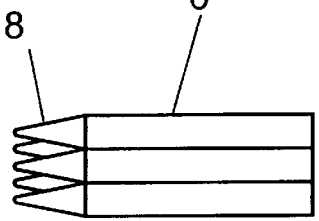
FIG. 3 depicts a side view of a stack of cylinders used as elements of a preferred embodiment of the present invention.
Figure 2:
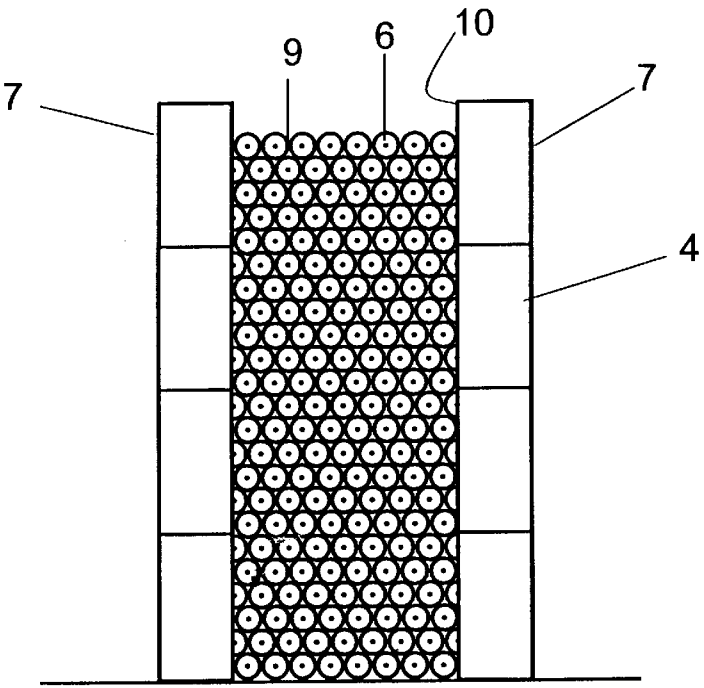
FIG. 2 depicts a frontal view of a preferred embodiment of the present invention from a shooter's perspective.
Figure 4:
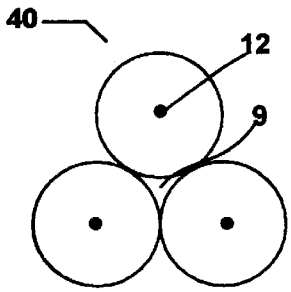
FIG. 4 depicts an end frontal view of cylinders stacked in an equilateral triangle configuration within a preferred embodiment of the present invention.
Figure 5:
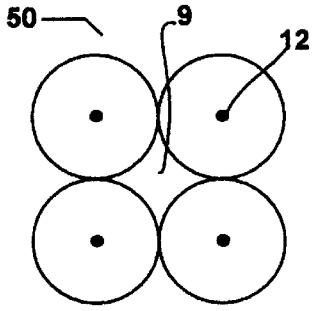
FIG. 5 depicts an end frontal view of cylinders stacked in square configuration within a preferred embodiment of the present invention.

Refer to FIG. 1. A shooter 1 fires a projectile (not separately shown), such as a bullet, along a trajectory 2. The projectile may pass through a target 3 before entering a screen 4 representing a preferred embodiment of the present invention. Should the projectile, or parts thereof, and any debris dislodged from the elements of the screen pass as reduced energy projectiles through voids provided in the screen, these projectiles and debris may hit a backstop 5. Further, if enough energy has been retained by these projectiles and debris they may rebound from the backstop and hit the rear of the screen 4 where they may embed in elements of the screen 4 or fall harmlessly to the bottom of the space between the rear of the screen 4 and the backstop 5.

Figure 6:
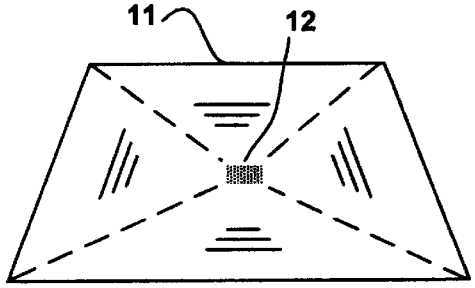
FIG. 6 depicts an end view of a cross section of a trapezoidal element within a preferred embodiment of the present invention.
Figure 7:
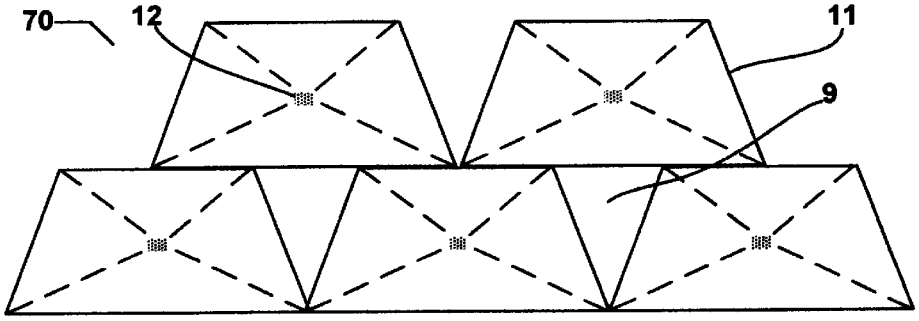
FIG. 7 depicts an end frontal view of trapezoidal cross section elements stacked in an equilateral triangle configuration within a preferred embodiment of the present invention.
Figure 8:
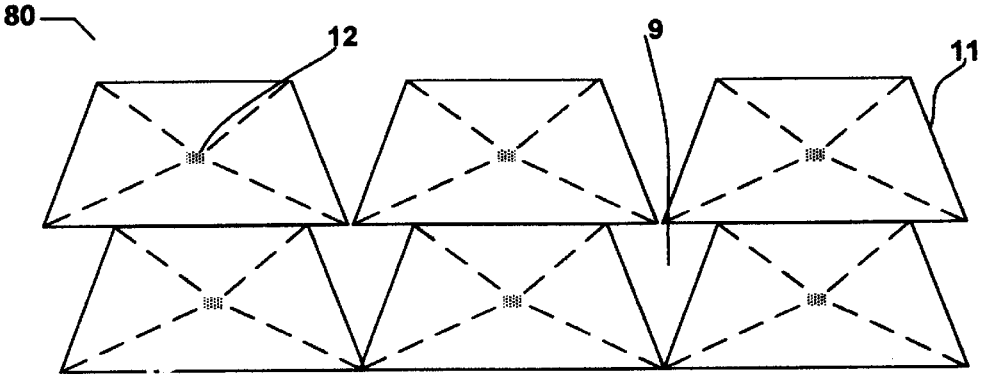
FIG. 8 depicts an end frontal view of trapezoidal cross section elements stacked in a square configuration within a preferred embodiment of the present invention.

Refer to FIG. 6, depicting an end view of an alternative trapezoidal cross section 11 for the internal elements of the screen 4. These trapezoidal cross section elements 11 may be stacked in an equilateral triangle configuration 70 as shown in FIG. 7 or in a square configuration 80 as shown in FIG. 8. The ends of the trapezoidal cross section 11 facing the shooter 1 come to a blunt end configuration 12 much like one would see on a cold chisel. This blunt configuration 12 permits internal elements having the trapezoidal cross section 11 to perform in a manner similar to internal elements having the cylindrical cross section 6.

Typical dimensions of the cylindrical logs are: diameter, 6" (15 cm); length of cylindrical portion, 3 ft (90 cm); length of conical portion, 1 ft (30 cm). It is to be understood that these dimensions are typical but not limiting. Shock absorbent material used in making the logs for the screen 4, preferably, is foamed, fiber-reinforced shock-absorbent concrete (SACON) weighing, typically, 90 lbs. per cubic foot (1.4 grams per cubic centimeter). The diameter of cylindrical logs, typically, is about 6" (15 cm). Each log weighs about 60 lbs. Bullet screens of this type can be used with weapons up to 0.50 caliber (12.7 mm). As noted, they can be used with tracer, incendiary, and deflagrating bullets without risk of igniting the screen.

The supporting blocks 7 holding the stacked bullet screen logs 6 in place may be wooden boxes filled with sand, or SACON which may contain a slight excess of calcium hydroxide, as described above which, when exposed to rain and moisture in the field, produces a slightly alkaline leachate that reduces the amount of heavy-metal contamination leaving the range, e.g., lead, that may result from the firing of lead bullets.

The dimensions of an installed bullet trap, typically, are as follows: width of the bullet screen, 8 ft (2.4 m); height of the bullet screen, 8 ft (2.4 m); and depth of 4 ft (1.20 m). including the conical heads. The width of the supporting blocks 7 for retaining the bullet screen is 2 ft (60 cm) on each side of the bullet screen; the height of the blocks is 2 ft (60 cm); the length of the blocks 7 is 3 ft (90 cm). A firing range 8 ft. high would have supporting blocks stacked four blocks high. It is to be understood that these dimensions are typical but not limiting.

It will be understood that the foregoing description of preferred embodiments of the present invention is for purposes of illustration only, and that the various structural and operational features herein disclosed are susceptible to a number of modifications and changes, none of which entail any departure from the spirit and scope of the present invention as defined in the following claims.

We claim:

1. A system for controlling the disposition of bullets and dislodged debris resulting from said bullets impacting at least part of said system comprising:

a bullet screen incorporating cylindrical logs, each having a conical configuration at one end thereof, wherein said logs are stacked such that said conical configuration faces said impacting bullets, and wherein said cylindrical logs are stacked to form openings between them that provide passage for said bullets and dislodged debris through said bullet screen; and stacked rectangular blocks comprising wooden boxes filled with sand for retaining said stacked cylindrical logs along two opposing sides of the longest dimension of said cylindrical logs.

2. The system of claim 1 in which said logs comprises a shock-absorbing, foamed, fiber-reinforced concrete.

3. The system of claim 2 in which said shock-absorbing, foamed, fiber-reinforced concrete further comprises calcium hydroxide excess to the formulation necessary to insure structural integrity of said concrete, wherein said excess calcium hydroxide serves to inhibit leaching of heavy metals that may be embedded in said internal elements.

4. The system of claim 2 in which said shock-absorbing, foamed, fiber-reinforced concrete is SACON®.

5. A screen for controlling the disposition of expended small arms munitions, comprising:

at least one durable internal element having one long dimension at least five times greater than any of said element's dimensions in a plane perpendicular to said long dimension, wherein said internal element incorporates a tapered configuration on at least one end, said at least one end defining the termination of said long dimension; and support for containing said at least one internal element, said support comprising blocks stacked vertically on either side of said long dimension of said at least one internal element.

6. The screen of claim 5 in which said blocks are rectangular in each of their main dimensions.

7. The screen of claim 6 in which said blocks comprise wooden boxes filled with sand.

8. The screen of claim 6 in which said blocks comprise concrete.

9. The screen of claim 8 in which said concrete comprises at least some shock-absorbing, foamed, fiber-reinforced concrete.

10. The screen of claim 9 in which said shock-absorbing, foamed, fiber-reinforced concrete is SACON®.

11. The screen of claim 5 in which said durable element comprises a shock-absorbing, foamed, fiber-reinforced concrete.

12. The screen of claim 11 in which said shock-absorbing, foamed, fiber-reinforced concrete further comprises calcium hydroxide excess to the formulation necessary to insure structural integrity of said concrete, wherein said excess calcium hydroxide serves to inhibit leaching of heavy metals that may be embedded in said internal elements.

13. The screen of claim 11 in which said shock-absorbing, foamed, fiber-reinforced concrete is SACON®.

14. A system for controlling the disposition of small arms munitions expended at a target close to the shooter of said munitions comprising:

a screen, comprising:

at least one durable internal element having one long dimension at least five times greater than any of said element's dimensions in a plane perpendicular to said long dimension, wherein said internal element incorporates a tapered configuration on at least one end. said at least one end defining the termination of said long dimension; and support for containing said at least one internal element in which said support comprises blocks stacked vertically on either side of said long dimension of the configuration of said at least one internal elements; and a backstop.

15. The system of claim 14 in which said blocks are rectangular in each of their main dimensions.

16. The system of claim 15 in which said blocks comprise wooden boxes filled with sand.

17. The system of claim 14 in which said blocks comprise concrete.

18. The system of claim 17 in which said concrete comprises at least some shock-absorbing, foamed, fiber-reinforced concrete.

19. The system of claim 18 in which said shock-absorbing, foamed, fiber-reinforced concrete further comprises calcium hydroxide excess to the formulation necessary to insure structural integrity of said concrete, wherein said excess calcium hydroxide inhibits leaching of heavy metals that may be embedded in said blocks.

20. The system of claim 18 in which said shock-absorbing, foamed, fiber-reinforced concrete is SACON®.

21. The system of claim 14 in which said durable element comprises a shock-absorbing, foamed, fiber-reinforced concrete.

22. The system of claim 21 in which said shock-absorbing, foamed, fiber-reinforced concrete further comprises calcium hydroxide excess to the formulation necessary to insure structural integrity of said concrete, wherein said excess calcium hydroxide serves to inhibit leaching of heavy metals that may be embedded in said internal elements.

23. The system of claim 21 in which said shock-absorbing, foamed, fiber-reinforced concrete is SACON®.

* * * * *